United States Patent [19]

Ghestem

[11] 4,089,641

[45] May 16, 1978

[54] ROTARY KILN WITH CLUSTER OF COOLING TUBES

[75] Inventor: Gerard Ghestem, Lambersart, France

[73] Assignee: Fives-Cail Babcock, Paris, France

[21] Appl. No.: 726,062

[22] Filed: Sep. 24, 1976

[30] Foreign Application Priority Data

Aug. 25, 1975 France ..... 75 26110

[51] Int. Cl.[2] ..... F27D 15/02

[52] U.S. Cl. ..... 432/80

[58] Field of Search ..... 432/80, 78

[56] References Cited

U.S. PATENT DOCUMENTS 3,920,381 11/1975 Heinemann ..... 432/80

3,994,677 10/1976 Mollenkopf et al. ..... 432/80

*Primary Examiner*—John J. Camby

*Attorney, Agent, or Firm*—Kurt Kelman

[57] ABSTRACT

Cooling tubes are secured to a tubular rotary kiln in circumferentially spaced relationship for movement with the kiln about the kiln axis. A longitudinally terminal part of each tube is connected with an axial end portion of the kiln by a radial duct so that the terminal tube part receives hot, processed material from the kiln by gravity when the tube is located below the kiln. A deflector in the tube deflects previously received material into the path of the hot material dropping from the duct into the tube when the tube approaches its position below the kiln, thereby protecting the inner tube wall against the impact of the hot, discharged material, and preventing rapid wear of the refractory tube lining.

10 Claims, 4 Drawing Figures

ROTARY KILN WITH CLUSTER OF COOLING TUBES

This invention relates to rotary kilns, and particularly to a kiln arrangement in which cooling tubes are clustered about the axial discharge end of a tubular kiln for receiving the hot material processed in the kiln and for cooling the material.

In the basically known kiln arrangement with the improvement of which this invention is concerned, the discharge end of the kiln is formed with a circumferential row of openings from which connecting ducts lead into respective cooling tubes fastened to the kiln for joint movement about the kiln axis. Each cooling tube receives hot material, such as cement clinkers, through the associated duct when the tube is in its lowermost position, the axis of rotation having at least a major horizontal component. Air is drawn or blown through the cooling tubes counter-current to the direction of movement of the cooled material, enters the kiln through the ducts and serves there as air of combustion.

The received material is caused to travel longitudinally through each cooling tube by gravity or by baffles, chains, or the like away from the discharge orifice of the associated connecting duct, and the resulting agitation of the particulate mass enhances heat exchange with the stream of air.

In some kiln arrangements of the type described, a portion of the material transferred from the kiln to a cooling tube in the lowermost position of the tube tends to return to the kiln when the tube approaches its topmost position during rotation of the kiln. To avoid the resulting waste of thermal energy, it has been proposed to give the connecting duct the shape of a spiral section. It has also been proposed to make the entrance ends of the tubes conical or of other shape to hasten the removal of the hot material from the longitudinally terminal part of the tube nearest the discharge orifice of the connecting duct.

It has been found that the known methods of preventing return of partially cooled material into the kiln sharply reduce the useful life of the cooling tube lining, usually of refractory material, on which the hot, processed material drops from the connecting duct. No economically available material of construction can withstand for extended periods the impact of clinkers discharged by gravity at their highest temperature once during each revolution of the kiln, typically once a minute.

A primary object of this invention is the provision of a kiln arrangement in which the rapid wear of the cooling tube linings and the resulting frequent shutdown of the kiln for repairs are avoided without losing the advantages of not returning material from the cooling tubes to the kiln cavity.

With this object and others in view, the invention provides a kiln arrangement in which an elongated tubular kiln is mounted for continuous rotation about a longitudinal axis extending horizontally, that is, having at least a major horizontal component. Circumferentially distributed ducts communicate with one axial end portion of the kiln for receiving hot material processed in the kiln. Each duct extends from the end portion of the kiln in a radially outward direction and has a discharge orifice remote from the kiln. Cooling tubes are secured to the kiln in circumferentially spaced relationship for rotary movement with the kiln. Each cooling tube is elongated in a horizontally extending direction and has a longitudinally terminal part communicating with a respective, associated duct through the discharge orifice of the associated duct for receiving processed material from the duct by gravity when the tube is in a certain position below the axis of rotation. A deflector device in each cooling tube deflects longitudinally into the terminal tube part a portion of the material previously received by the tube when the tube approaches the receiving position during kiln rotation. In this manner, hot material discharged from the duct orifice by gravity during each revolution of the kiln impinges on material discharged into the cooling tube during a previous revolution of the kiln.

Other features, additional objects, and many of the attendant advantages of this invention will readily be appreciated as the same becomes better understood from the following detailed description of preferred embodiments when considered in connection with the appended drawing in which.

Figure 1:
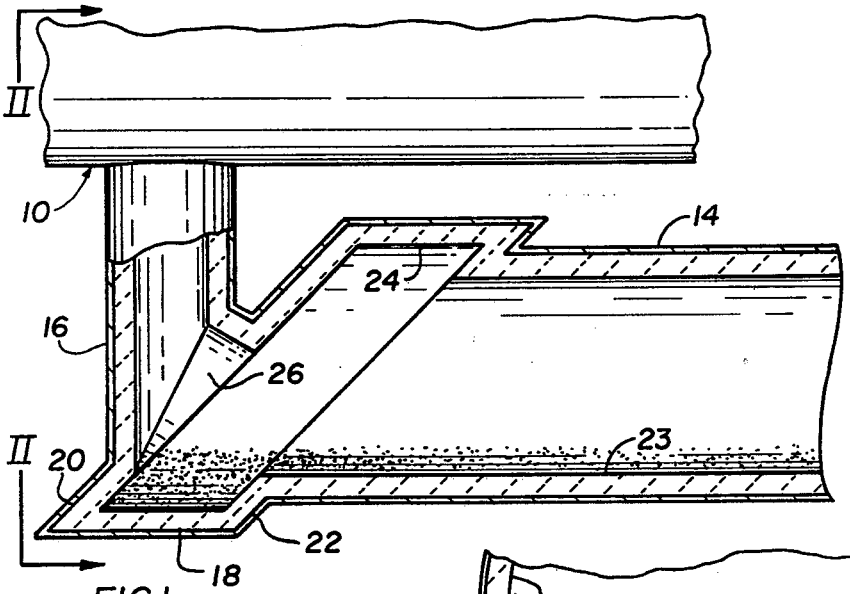
FIG. 1 is a fragmentary, elevational view, partly in section, of a kiln arrangement of the invention.
Figure 2:
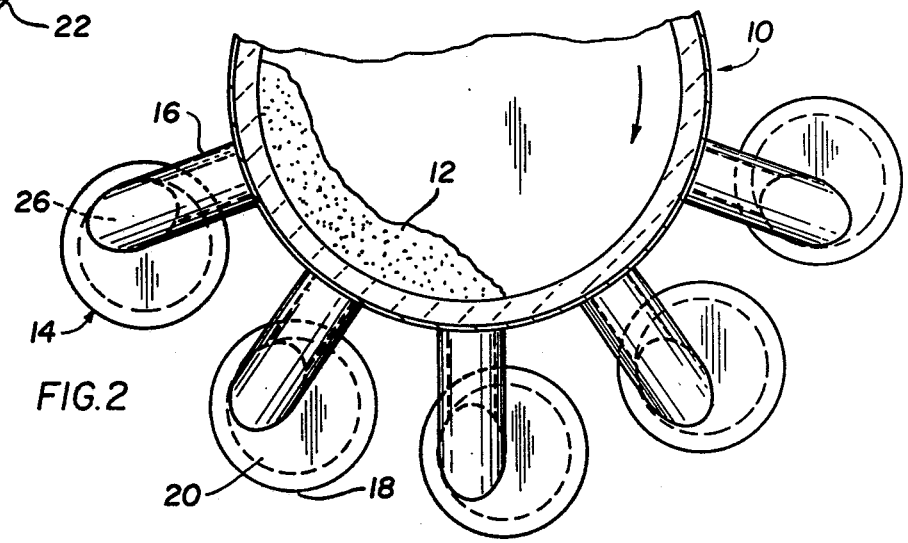
FIG. 2 shows the apparatus of FIG. 1 in fragmentary section on the line II—II in FIG. 1.

Referring now to the drawing in detail, and initially to FIGS. 1 and 2, there is shown only as much of an otherwise conventional kiln arrangement for making Portland cement as is needed for an understanding of this invention. The tubular rotary kiln 10 is mounted in non-illustrated sleeve bearings and is rotated about its longitudinal axis as indicated by an arrow in FIG. 2, the driving mechanism being well known and not illustrated. Cement clinkers 12 formed in the kiln 10 travel axially toward the illustrated end portion of the kiln 10 because of an oblique slope of the horizontally extending axis of kiln rotation or due to baffles in the kiln cavity, not shown. Cooling tubes 14 are clustered circumferentially about the discharge end of the kiln 10 and communicate with the kiln cavity through connecting ducts 16 which radiate from respective openings in the kiln. When a cooling tube 14 is located below the axis of kiln rotation, hot clinkers 12 drop through the associated duct 16 and are discharged from the radially outer orifice of the duct into the cooling tube. The clinkers are moved longitudinally in the tube 14 away from the orifice of the associated duct 16 either by gravity or by chains or baffles, not illustrated, but conventional. Air moves countercurrent to the clinkers 12 from each tube 14 through the associated duct 16 into the kiln 10. The structure described so far is not new.

As is shown in FIG. 1, the radially outer orifice of the duct 16 is bounded by an annular end face of the duct in a plane inclined to the duct axis at approximately 45°, and is partly sealed by an end wall 20 of the cooling tube 14 similarly inclined relative to the longitudinal axis of the tube. The longitudinally terminal portion 18 of the tube 14 is transversely enlarged between the end wall 20 and an annular flat wall 22 parallel to the end wall 20. The refractory lining 23 of the cooling tube 14 is of approximately uniform thickness so that the lined walls 20, 22 and the enlarged tube portion 18 bound an annular groove 24 in the interior of the cooling tube 14.

An aperture 26 in the end wall 20 communicates with the discharge orifice of the duct 16 and is aligned radially with the portion of the groove 24 radially farthest from the kiln 10. The portion of the groove 24 radially nearest the kiln 10 is offset from the farthest portion farther downstream in the overall direction of clinker movement through the tube 14. The face of the end wall 20 bounding the groove 24, therefore, slopes obliquely downward and away from the orifice of the duct 16 longitudinally of the tube 14 when the tube 14 approaches its non-illustrated, uppermost position during each revolution of the kiln 10. As is best seen in FIG. 2, the aperture 26 in each end wall 20 is offset from the central, longitudinal axis of each tube 14 in the direction of kiln rotation.

Whenever a tube 14 is at or near its lowermost position, hot clinkers 12 drop from the kiln 10 through the associated duct 16 first into the groove 24 and overflow from the groove. During the upward movement of the tube, material previously trapped in the groove 24 is deflected away from the duct 16 along the adjacent face of the wall 20, but remains in the groove, and is returned by the deflecting groove walls to a position downwardly aligned with the aperture 26 to protect the refractory lining of the groove against the impact of the next batch of hot clinkers discharged from the duct 16. The amount of material retained in the groove 24 is limited by the depth of the groove, and any excess is moved longitudinally toward the non-illustrated discharge end of the cooling tube in a conventional manner, not illustrated in detail.

While a wall 20 having a flat face bounding the groove 24, as illustrated, has been found to be effective in preventing the return of significant amounts of clinker from the cooling tube 14 into the kiln 10, the face may be given a conical curvature or a convexly spherical shape to retain in the tube 14 all material received from the duct 16 during rotation of the kiln 10.

Figure 4:
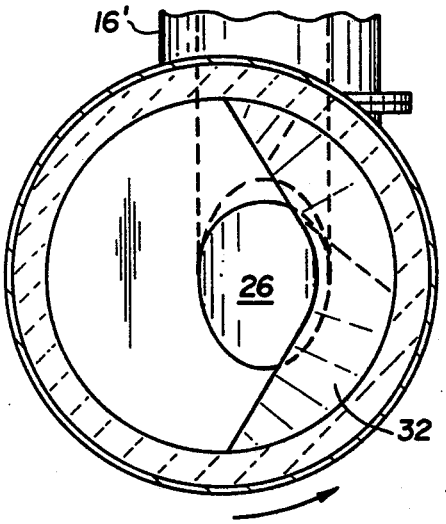
FIG. 4 shows the device of FIG. 3 in section on the line IV—IV.
Figure 3:
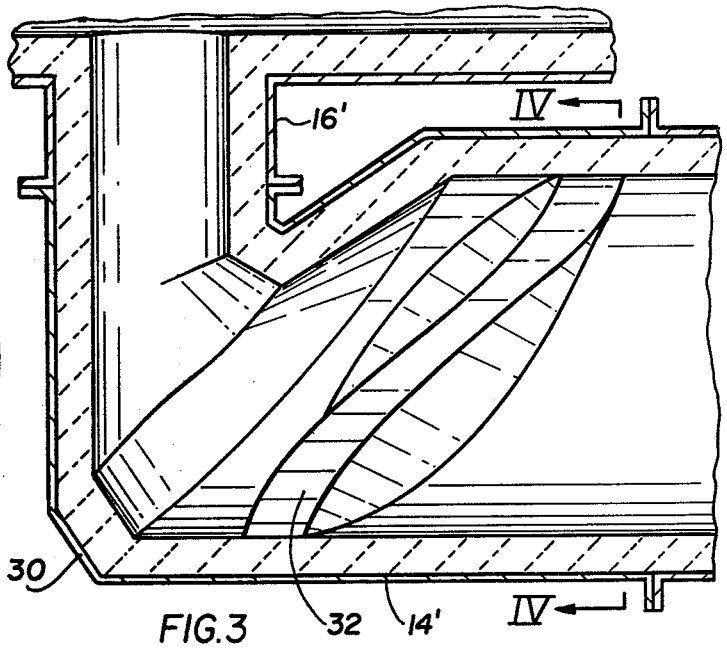
FIG. 3 illustrates a modification of a portion of the apparatus of FIG. 1.

In the modified apparatus illustrated in FIGS. 3 and 4, the main portion of each cooling tube 14' is cylindrical and joined to an associated connecting duct 16' by a frustoconical section 30 whose axis is obliquely inclined to the axis of the cylindrical portion. The refractory lining of the tube 14' is provided with an integral deflecting rib 32 projecting from the cylindrical inner tube wall. The rib extends along one half turn of a steep helix about the tube axis, and its ends taper from the greatest projecting height of the central rib portion. The ends are located approximately in the plane defined by the axis of rotation of the kiln, not itself shown in FIGS. 3 and 4, and the central, longitudinal axis of the tube 14 which divides the interior of the tube 14' into a leading portion and a trailing portion, relative to the direction of kiln rotation indicated by an arrow in FIG. 4. The rib 32 is located entirely, or practically entirely, in the leading portion of the tube interior. The rib thereby has the approximate shape of a crescent, and it is trapezoidal in cross section.

The end of the rib 32 radially nearest the kiln is located downstream from the other rib end, as viewed in the overall direction of clinker movement through the tube 14'. The rib, therefore, longitudinally deflects a small amount of clinker opposite to the overall direction of clinker movement when the tube 14' approaches its illustrated lowermost position during kiln rotation, as described above with reference to the groove 24.

The illustrated connecting ducts and cooling tubes are conventionally constructed of metal shells lined with refractory cement which also constitutes the rib 32, but the invention is not limited to specific materials of construction which will be selected by those skilled in the art to suit specific conditions. The use of a rib having a metallic core fastened to the tube shell and a refractory coating on the core is specifically contemplated.

What is claimed is:

1. A rotary kiln arrangement comprising:

(a) an elongated, tubular kiln having a longitudinal, horizontally extending axis and mounted for continuous rotation about said axis;

(b) a plurality of circumferentially distributed ducts communicating with one axial end portion of said kiln for receiving hot material processed in said kiln, each duct extending from said end portion in a radially outward direction and having a discharge orifice remote from said kiln;

(c) a plurality of cooling tubes secured to said kiln in circumferentially spaced relationship for movement with said kiln about said axis, each cooling tube being elongated in a horizontally extending direction and having a longitudinally terminal part communicating with a respective, associated duct through the discharge orifice of the associated duct for receiving said material from said duct by gravity when said tube is in a predetermined position below said axis; and (d) deflector means in each cooling tube for deflecting into said terminal part longitudinally of said tube a portion of the material previously received by said tube when said tube approaches said position during said rotation of the kiln, the deflector means being arranged to retain said material portion under the duct and oriented to thrust said material portion into the cooling tube whereby hot material discharged from said orifice by gravity during each revolution of said kiln impinges on material discharged into said cooling tube during a previous revolution of the kiln.

2. An arrangement as set forth in claim 1, wherein each tube has an inner longitudinal wall, and said deflector means include a rib projecting into the interior of said tube from said wall.

3. An arrangement as set forth in claim 2, wherein said rib is obliquely inclined relative to the direction of tube elongation.

4. A rotary kiln arrangement comprising:

(a) an elongated, tubular kiln having a longitudinal horizontally extending axis and mounted for continuous rotation about said axis;

(b) a plurality of circumferentially distributed ducts communicating with one axial end portion of said kiln for receiving hot material processed in said kiln, each duct extending from said end portion in a radially outward direction and having a discharge orifice remote from said kiln;

(c) a plurality of cooling tubes each having an inner longitudinal wall, the tubes being secured to said kiln in circumferentially spaced relationship for movement with said kiln about said axis, each cooling tube being elongated in a horizontally extending direction and having a longitudinally terminal part communicating with a respective, associated duct through the discharge orifice of the associated duct for receiving said material from said duct by gravity when said tube is in a predetermined position below said axis; and (d) deflector means including a rib projecting into the interior of said tube from said inner longitudinal wall, the rib being obliquely inclined relative to the direction of tube elongation for deflecting into said terminal part longitudinally of said tube a portion of the material previously received by said tube when said tube approaches said position during said rotation of the kiln, said direction and said axis defining a plane dividing said interior into a portion leading during said rotation of the kiln and a portion trailing during said rotation, said rib being substantially entirely located in said leading portion and having two ends respectively adjacent said kiln and remote from said kiln in a radial direction, said adjacent portion being offset from said remote portion longitudinally of said tube in a direction away from said orifice whereby hot material discharged from said orifice by gravity during each revolution of said kiln impinges on material discharged into said cooling tube during a previous revolution of the kiln.

5. An arrangement as set forth in claim 4, wherein the projecting height of said rib decreases toward said two ends from a portion of said rib intermediate said ends.

6. An arrangement as set forth in claim 5, wherein said tube has a metallic shell and a refractory lining bounding said interior, said rib being integral with said lining.

7. An arrangement as set forth in claim 1, wherein said deflector means include a deflector member formed with an aperture communicating with said orifice and having a face directed away from said orifice in the direction of elongation of said tube.

8. A rotary kiln arrangement comprising:

(a) an elongated, tubular kiln having a longitudinal, horizontally extending axis and mounted for continuous rotation about said axis;

(b) a plurality of circumferentially distributed ducts communicating with one axial end portion of said kiln for receiving hot material processed in said kiln, each duct extending from said end portion in a radially outward direction and having a discharge orifice remote from said kiln;

(c) a plurality of cooling tubes secured to said kiln in circumferentially spaced relationship for movement with said kiln about said axis, each cooling tube being elongated in a horizontally extending direction and having a longitudinally terminal part communicating with a respective, associated duct through the discharge orifice of the associated duct for receiving said material from said duct by gravity when said tube is in a predetermined position below said axis; and (d) deflector means including a deflector member formed with an aperture communicating with said orifice and having a face directed away from said orifice in the direction of elongation of said tube, said face bounding an annular groove extending in said wall in a plane obliquely inclined relative to said direction of elongation, respective portions of said groove being radially nearest and farthest from said kiln, said farthest portion being radially aligned with said aperture, and said nearest portion being offset from said nearest portion in said direction of elongation away from said aperture whereby hot material discharged from said orifice by gravity during each revolution of said kiln impinges on material discharged into said cooling tube during a previous revolution of the kiln.

9. An arrangement as set forth in claim 8, wherein said face slopes obliquely downward and away from said orifice in the direction of elongation of said tube while said tube moves upward from said position thereof during said rotation of the kiln.

10. An arrangement as set forth in claim 9, wherein said tube has a central, longitudinal axis, and said aperture is offset from said central axis in the direction of rotation of said kiln.

* * * * *